US006346769B1

(12) United States Patent
Saito et al.

(10) Patent No.: US 6,346,769 B1
(45) Date of Patent: Feb. 12, 2002

(54) ELECTRON BEAM DEFLECTION DEVICE FOR CATHODE RAY TUBE

(75) Inventors: Ichiro Saito; Koichi Iida, both of Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/499,613

(22) Filed: Feb. 7, 2000

(30) Foreign Application Priority Data

Feb. 22, 1999 (JP) ..... 11-043736
Feb. 25, 1999 (JP) ..... 11-048639

(51) Int. Cl.[7] ..... H01J 40/00; H01J 40/16
(52) U.S. Cl. ..... 313/440; 335/210; 335/211; 335/212; 335/213
(58) Field of Search ..... 313/440; 335/210, 335/211, 212, 213

(56) References Cited

FOREIGN PATENT DOCUMENTS

JP 403149733 A * 6/1991

OTHER PUBLICATIONS

K.K.N. Chang, "An Experimental "In–Neck" Integrated Yoke"; RCA Laboratories, Princeton, NJ; SID 84 Digest; pp. 264–267.

Y. Sano, M. Yokota, T. Kojima, H. Murata, H. Mori, "A High–Deflection–Sensitivity CDT with Rectangular Yoke"; Toshiba Corp., Saitama, Japan; SID 98 Digest; pp. 85–88.

* cited by examiner

*Primary Examiner*—Sandra O'Shea
*Assistant Examiner*—Ali Alavi
(74) *Attorney, Agent, or Firm*—Rader, Fishman & Grauer PLLC; Ronald P. Kananen

(57) ABSTRACT

An electron beam deflection device for a cathode ray tube in which the power for deflecting an electron beam may be reduced easily and convergence may be adjusted easily. The electron beam deflection device has a horizontal deflection yoke and a vertical deflection yoke which are arranged at different positions relative to each other in the fore-and-aft direction. A first core constituting the horizontal deflection yoke is of a flat annular shape. The upper and lower inner surfaces of the first core operate as opposing magnetic poles. A second core constituting the vertical deflection yoke may be of a flat annular shape or of a circular or square annular shape. The forward or rear end of the first core or the forward or rear end of the second core is provided with a cut-out for adjusting the convergence.

8 Claims, 5 Drawing Sheets

ELECTRON BEAM DEFLECTION DEVICE FOR CATHODE RAY TUBE

BACKGROUND OF THE INVENTION

1. Field of the Invention

This invention relates to an electron beam deflection device and, more particularly, to a device for deflecting three electron beams emitted by an electron gum of a cathode ray tube by s magnetic field.

2. Description of the Prior Art

A cathode ray tube, used as a display device, has an electron gun and a panel at a rear portion and a forward portion thereof, respectively.

The electrons emitted from the cathode of the electron gun are accelerated by a set of electrodes of the electron gun to generate an electron beam.

If this electron beam collides against a phosphor surface applied on the panel, light is generated at a point of collision. By this emitted light, the picture information is displayed.

In a color cathode ray tube, an electron gun for generating three electron beams are used.

The three electron beams of the cathode ray tube collide against the phosphor surface on which phosphors for red, green and blue are arrayed.

The light beams of red, green and blue are produced on the respective collision points on the phosphor surface.

These light beams are mixed by an additive process and observed as colors.

In this case, the three electron beams need to be selectively struck against the phosphors for red, green and blue colors.

To this end, a color selection mechanism, having a large number of slits or rectangular or circular apertures, is arranged between the phosphor surface and the electron gun.

The picture information has two-dimensionally spreading characteristics.

For displaying a picture, the electron beams of the cathode ray tube are swept two-dimensionally.

For sweeping the electron beam, an electron beam deflection device for generating a magnetic field or an electric field is provided near the rear end of the electron gun of the cathode ray tube.

The device for deflecting the electron beam using a magnetic field is termed a deflection yoke, and includes a horizontal deflection coil, a vertical deflection coil and a core.

The perimeter of the horizontal deflection coil and the vertical deflection coil is routinely encircled by a common magnetic core.

Thus, the horizontal deflection coil, vertical deflection coil and the core are unified together.

The horizontal deflection coil and the vertical deflection coil generate mutually perpendicular magnetic fields.

If the current flowing in the respective coils is changed, the phosphor surface is two-dimensionally swept by the electron beam.

The deflection yoke is mounted on the rear side of the cathode ray tube.

Specifically, the deflection yoke is mounted, from a portion of the cathode ray tube termed a "neck", for encircling a portion of the cathode ray tube termed a "funnel" from outside.

This neck portion of the cathode ray tube is cylindrically-shaped and the electron gun is mounted in this cylindrical portion.

The funnel portion, consecutive to the neck portion, is spread out conically.

The inner surface of the deflection yoke is conically-shaped, in continuation to the cylindrical shape, so as to be suited to the outer surface of the neck and funnel portions.

In the above-described cathode ray tube, the electron beams proceed from the neck portion to the funnel portion.

The strength of the magnetic field, acting on the electron beams, is proportional to a reciprocal of the distance between the electron beams and the coil, in accordance with the ampere's law.

The deflection yoke is designed to follow the outer surface of the cathode ray tube.

If the diameter of the neck portion of the cathode ray tube is reduced, it is possible to design the deflection yoke with a smaller inner diameter.

The result is the reduced distance between the electron beam and the deflection coil. The magnitude of the current necessary for deflection of the electron beam becomes smaller such that the power required for deflecting the electron beam, that is the deflection power, becomes smaller.

However, with a cathode ray tube with a smaller diameter of the neck portion, there is no alternative but to use an electron gun of a smaller diameter.

With the electron gun of the smaller diameter, the electron lens provided in its electrode portion is small in diameter. Thus, the electron lens suffers from increased aberration, thus leading to an increased spot diameter and the worsened resolution of the displayed picture.

That is, reduction in the deflection power of the deflection yoke and the improvement in the image-forming performance of an electron beam are in a trade-off relation to each other.

Up to now, for maintaining the pre-set image-forming capacity, the diameter of the neck portion cannot be reduced beyond 22 mm. That is, there is a certain limitation in reducing the diameter of the inner surface of the deflection yoke, thus presenting difficulties in reducing the deflection power.

In the color cathode ray tube, color display is by an additive process. Therefore, it is desirable that the points of collision of the three electron beams be coincident on the phosphor surface.

The points of collision of the three electron beams on the phosphor surface being brought into coincidence with one another is termed convergence. This convergence is among critical characteristics of a color cathode ray tube. In order to assure satisfactory convergence, the deflection magnetic field needs to be adjusted to high precision.

In the conventional deflection yoke, the deflection magnetic field is adjusted by adjusting the winding distribution of the deflection coil. However, the winding distribution of the deflection coil is affected by a large number of factors, such as winding position, winding density or winding tension.

For obtaining the desired deflection magnetic field, it is necessary to optimize these factors. Thus, elaborate operations are required in the designing and production of deflection yokes.

As a technique of reducing the deflection power, specifically, the square product $Li^2$ of the inductance L of the deflection yoke and the current supplied to the deflection yoke, there is known such a technique in which the deflection yoke is enclosed in the neck portion, as disclosed in "K.K.N Chang, "An Experimental In-Neck Integrated Yoke", SID84, Digest, p.264.

This technique resides in having the deflection yoke enclosed in the neck portion to reduce the inner diameter of the deflection yoke to reduce the deflection power.

It is however difficult to adjust e.g. the position of the deflection coil from outside the cathode ray tube.

Also, in the publication disclosed in Y. Sano et al., "A High-Deflection-Sensitivity CDT with Reef Angular Yoke", SID 98 Digest, p85, there is proposed a technique in which a deflection yoke is square-shaped in keeping with the angle of deflection in the vertical and horizontal directions, the neck portion is also square-shaped in meeting therewith and a groove is formed in the core inner wall for placing the coil thereon.

In this construction, the linkage between the magnetic field generated by the deflection coil and the core becomes stronger to render it possible to reduce the deflection power.

However, with this technique, the deflection power can be reduced only by about 23%.

Also, in the above-mentioned two techniques, the deflection magnetic field is adjusted depending on the winding distribution of the deflection coil. The result is that the designing and manufacture of deflection yokes are extremely labor-consuming, as conventionally.

SUMMARY OF THE INVENTION

It is therefore an object of the present invention to provide an electron beam deflection device whereby the deflection power can be reduced and the convergence in a color cathode ray tube may be adjusted easily.

In one aspect, the present invention provides an electron beam deflection device for a cathode ray tube including a horizontal deflection yoke constituted by a first core and a first coil, and a vertical deflection yoke constituted by a second core and a second coil, wherein the horizontal deflection yoke is mounted on an electron gun side of the cathode ray tube, and wherein the vertical deflection yoke is mounted on a phosphor surface side of the cathode ray tube.

In another aspect, the present invention provides an electron beam deflection device for a cathode ray tube including a horizontal deflection yoke constituted by a first core and a first coil, and a vertical deflection yoke constituted by a second core and a second coil, wherein the first core is of a flat annular shape, with upper and lower surfaces of a through-hole thereof operating as facing magnetic poles, the horizontal deflection yoke is mounted on an electron gun side of the cathode ray tube and wherein the vertical deflection yoke is mounted on a phosphor surface side of the cathode ray tube.

The electron beam deflection device according to the present invention is constituted by a deflection yoke for deflecting the electron beam of the cathode ray tube in the horizontal direction and a deflection yoke for deflecting the electron beam of the cathode ray tube in the vertical direction.

The deflection yoke for horizontal deflection and the deflection yoke for vertical deflection are provided at respective different positions in the fore-and-aft direction.

The horizontal deflection yoke has a magnetic core having opposite magnetic poles of the flat annular shape, thereby appreciably decreasing the deflection power in the horizontal direction. The deflection magnetic field is adjusted by the cut-out on an end of the magnetic core, this adjusting the convergence of the cathode ray tube.

DESCRIPTION OF THE PREFERRED EMBODIMENTS

Figure 1:
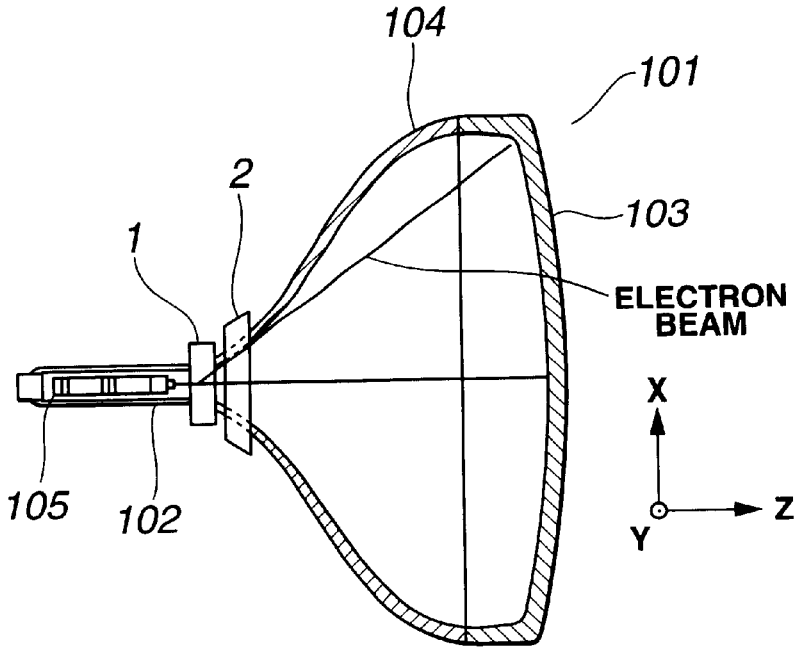
FIG. 1 is a top plan view of a cathode ray tube employing an electron beam deflection device according to the present invention, partially shown in cross-section.

Referring to the drawings, preferred embodiments of according to the present invention will be explained in detail.

Referring to FIG. 1, an electron beam deflection device according to the present invention is mounted on the outer surface of the cathode ray tube 101.

The cathode ray tube 101 has a substantially cylindrical rear neck portion 102 and a substantially rectangular forward panel 103.

The neck portion 102 and the panel 103 are interconnected via a conically-shaped funnel portion 104.

An electron gun 105 is mounted in the neck portion 102 and emits three electron beams, namely an electron beam for red display, an electron beam for green display and an electron beam for blue display.

These electron beams impinge on a phosphor surface provided on the back side of the panel 103.

When the electron beam impinges on the phosphor surface, the light of a pre-set color is produced form the phosphor, thus demonstrating the picture information.

Between the phosphor surface and the electron gun 105, there is arranged a color selection mechanism having a large number of slits, or rectangular or circular apertures.

Figure 2:
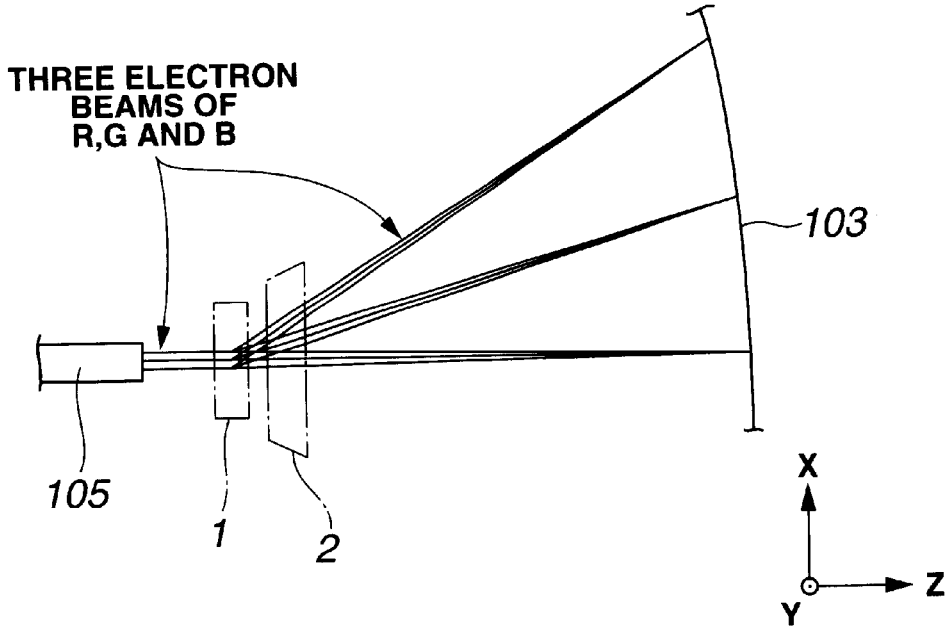
FIG. 2 is a top plan view showing the electron beam deflecting operation in the electron beam deflection device according to the present invention.

Meanwhile, the color selection mechanism is not shown in FIG. 1 or 2.

In the electron beam deflection device, a horizontal deflection yoke 1 and a vertical deflection yoke 2 are mounted separately from each other and on the neck portion 102 towards the electron gun 105 and towards the panel 103, respectively.

Referring to FIG.2, three electron beams, radiated from the electron gun 105, are subjected to the Lorenz's force by the horizontal deflection yoke 1 arranged towards the electron gun 105.

The three electron beams then are subjected to the Lorenz's force by the vertical deflection yoke 2 arranged towards the panel 103.

Moreover, the magnetic field needs to be adjusted so that, when the electron beams are swept on the entire panel 103, optimum convergence will be obtained at any position on the panel 103.

Figure 3:
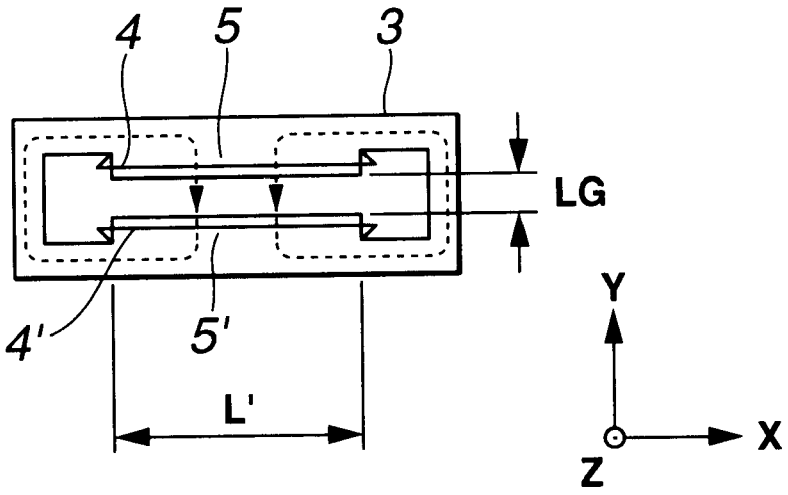
FIG. 3 is a front view showing the structure of a horizontal deflection yoke employed in the electron beam deflection device according to the present invention.

The horizontal deflection yoke 1 is made up of a flat annular core 3 and a pair of deflection coils 4, 4', as shown in FIG. 3.

The inner rim of the core 3 is formed with protuberant coil winding sections 5, 5' facing each other.

On the outer peripheral surfaces of these coil winding sections 5, 5' are placed deflection coils 4, 4' so that end portions thereof prove magnetic poles.

The direction in which these coil winding sections 5, 5' face each other corresponds to the short axis direction of the core 3.

The electron beam of the cathode ray tube traverses a center through-hole of the core 3.

The vertical deflection yoke 2 is substantially of the same structure as the horizontal deflection yoke 1, although the overall size of the vertical deflection yoke 2 is larger than that of the horizontal deflection yoke 1.

However, in the present vertical deflection yoke 2, the facing magnetic poles are arranged at a position rotated 90° with respect to the position of the facing magnetic poles of the horizontal deflection yoke 1.

That is, the direction in which the coil winding sections of the vertical deflection yoke 2 face each other is the long-axis direction of the core.

Usually, the electron beam sweeping frequency for horizontal deflection is 15 kHz or more, while that for vertical deflection is of the order of 50 to 100 Hz.

That is, the current flowing in the horizontal deflection yoke 1 is at a higher frequency than that flowing in the vertical deflection yoke 2.

Therefore, reduction in the deflection power of the horizontal deflection yoke 1 is more critical than that of the vertical deflection yoke 2.

The through-hole in the mid portion of the core 3 is elongated in a transverse direction, as shown in FIG. 3.

Thus, the portions of the cathode ray tube 101 carrying the deflection yokes 1, 3 are flat in profile and elongated in the horizontal direction, as shown in FIG. 1. The remaining portions of the cathode ray tube 101 are of a routine profile.

The electron beam deflection device of the present invention is now compared to a conventional deflection yoke.

Figure 4:
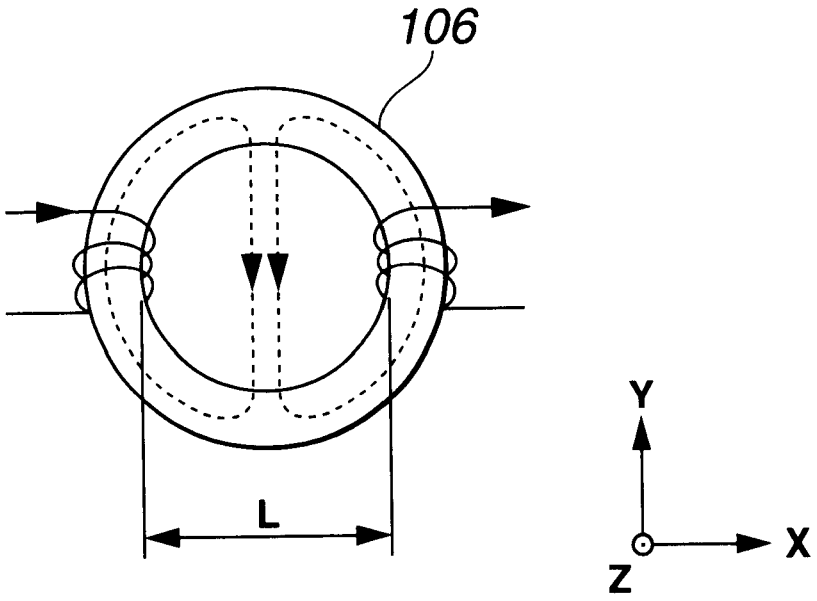
FIG. 4 is a front view showing a deflection yoke employing an annular core for comparison with the horizontal deflection yoke employed in the present invention.
Figure 5:
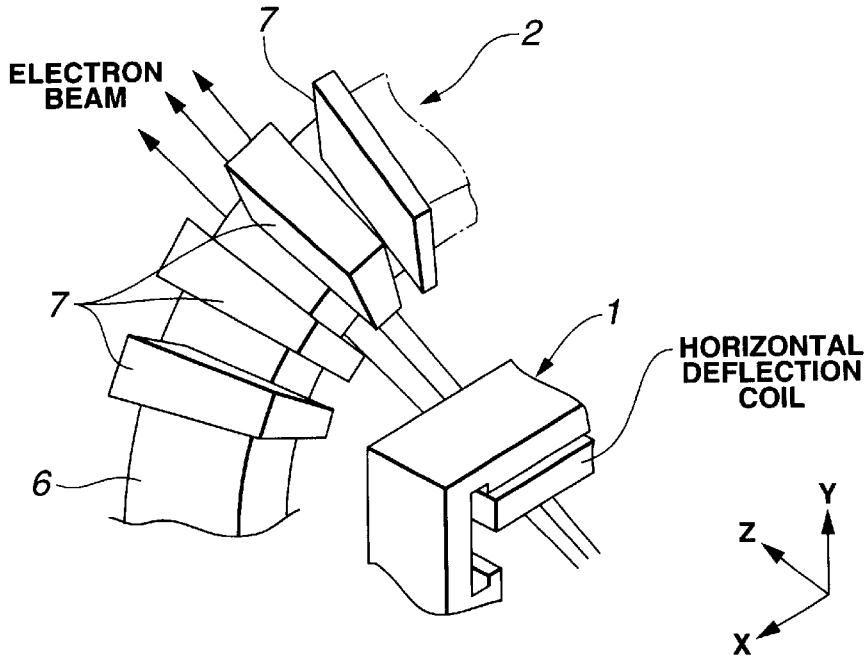
FIG. 5 is a perspective view showing essential portions of a modification of an electron beam deflection device according to the present invention.

The conventional deflection yoke has a toroidally-shaped core 106, as shown in FIG. 4.

This toroidally-shaped core 106 has an inner diameter size L which is substantially equal in any arbitrary direction.

On the other hand, in the inventive deflection yoke, the width-wise size L' of the coil winding section 5 is approximately equal to-the inner diameter size L of the conventional core 106, with the distance LG between the magnetic poles being not larger than the inner diameter LG.

With the deflection yoke, employing the core 3, the space exhibiting high magnetic reluctance becomes smaller.

Also, the entire core can be reduced in size, such that the length of the magnetic path length is reduced, with the magnetic reluctance being smaller. Thus, the magnetic field not less than twice the unit magnetomotive force can be produced.

Moreover, with the deflection yoke, the magnetic path length and also the inductance can be reduced.

The deflection device of the present invention was fitted on a 20-inch size cathode ray tube and measurement was made of the deflection power for horizontal deflection. It was found that the deflection power in this case could be reduced to one half that when the conventional deflection coil is used.

Figure 6:
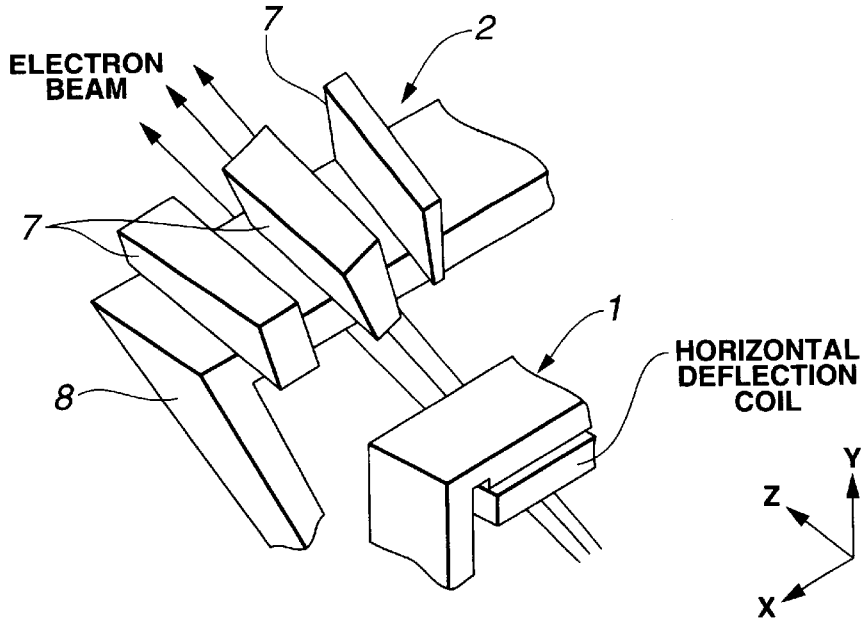
FIG. 6 is a perspective view showing essential portions of another modification of an electron beam deflection device according to the present invention.

Also, in the present invention, the horizontal deflection yoke 1 may be of the above-described structure and the vertical deflection yoke 2 may be a vertical deflection coil 7 in which a winding is placed on a cylindrical core 6 in a toroidal fashion, as shown in FIG. 6.

Figure 7:
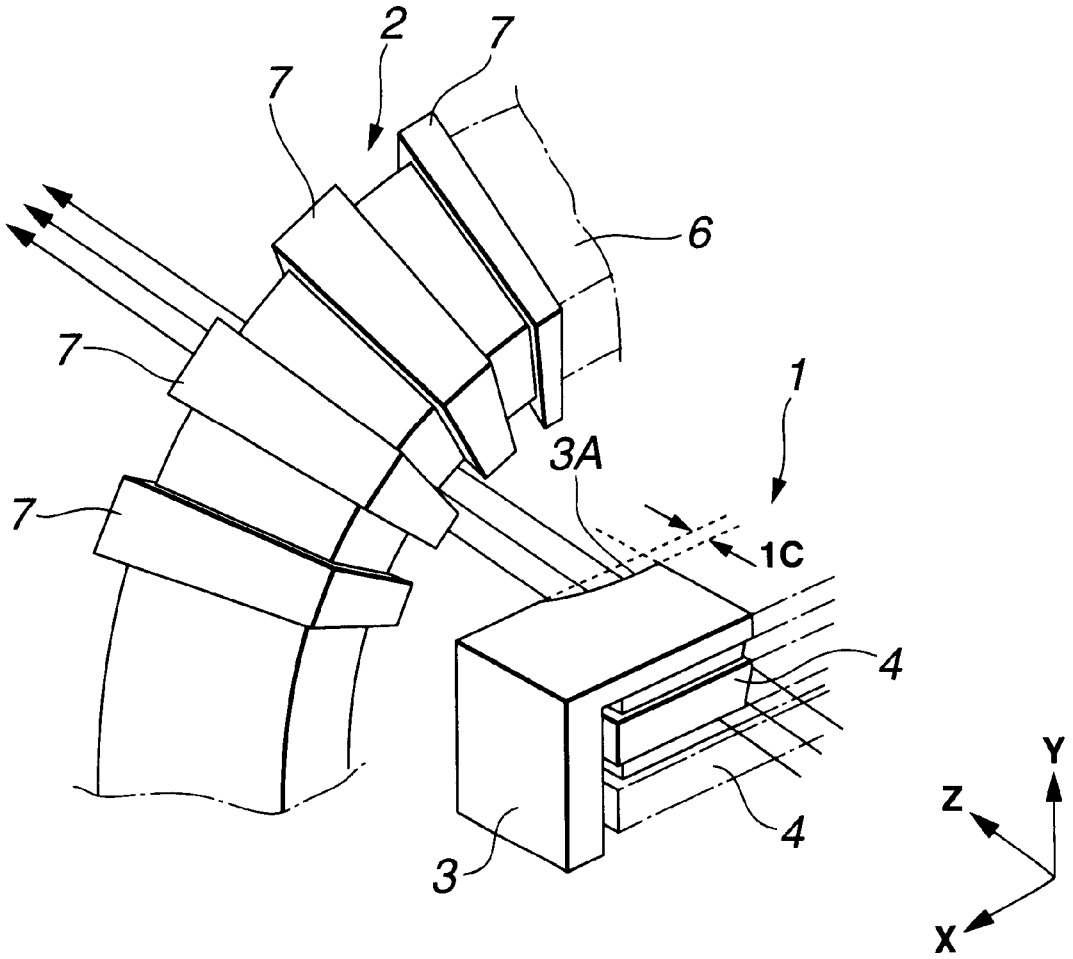
FIG. 7 is a perspective view showing essential portions of yet another modification of an electron beam deflection device according to the present invention.

Also, in the present invention, the horizontal deflection yoke 1 may be of the above-described structure and the vertical deflection yoke 2 may be a vertical deflection coil 7 in which a winding is placed on a core 8 of the rectangular frame shape in a toroidal fashion, as shown in FIG. 7.

Meanwhile, the core 8 of the rectangular frame shape may also be of a squared conical shape flared from the side of the horizontal deflection yoke 1 towards the panel 103 (pyramid-shape).

Adjustment of the deflection magnetic field is hereinafter explained.

FIG.7 shows an example of a deflection device adjusted for the deflection magnetic field. The core 3 of the horizontal deflection yoke 1 is formed with a substantially circular cut-out 3A in an edge via which an electron beam is radiated.

Between the magnetic fields of the core, the magnetic field has a distribution from the center of the core towards outside.

The three electron beams are subjected at the center to the Lorentz's force different from that at the outer side.

The result is that the relation among the trajectories of the three electron beams differs with the shape and the depth of the cut-out 3A.

The convergence can be adjusted by suitably setting the shape and the depth 1C of the cut-out 3A.

The vertical deflection yoke 2 has a cylindrical core 6.

On the outer periphery of the core 6 are mounted plural vertical deflection coils 7 in a toroidal fashion.

In this structure, the electron beam is subjected to the vertical deflection magnetic field on an inner side of the cylindrical core 6 having a wider space.

Figure 8:
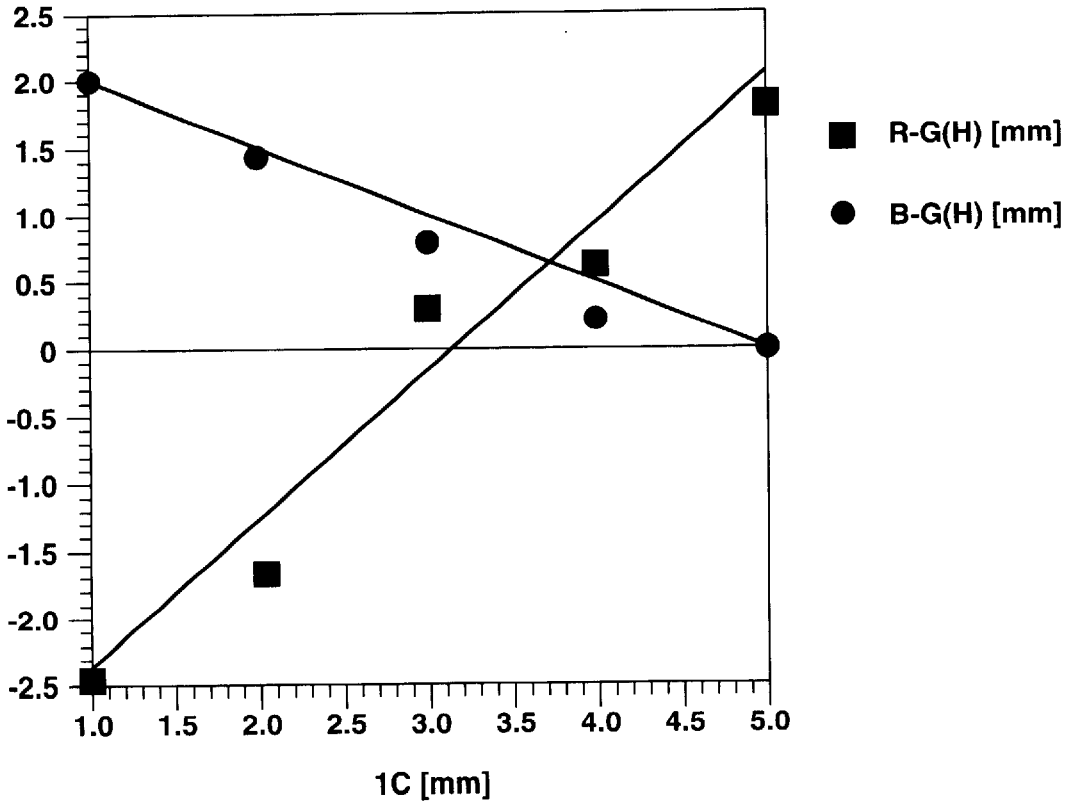
FIG. 8 is a graph showing the relation between the depth of cut in a core and the convergence in a horizontal deflection yoke employed in the present invention.

The amount of convergence deviation is related with the depth 1C of the cut-out 3A, as shown in FIG. 8.

In this figure, the amounts of deviation of the electron beam for red and the electron beam for blue with respect to the amount of deviation of the electron beam for green light are shown with respect to the depth 1C of the cut-out 3A as a variable.

In FIG. 8, R-G(H) indicates the position offset in the horizontal direction on the phosphor surface of the electron beam for red light with the position of the electron beam for green light on the phosphor surface.

Also, in FIG. 8, B-G(H) indicates the position offset on the phosphor surface of the electron beam for blue light, with the position on the phosphor surface of the electron beam for green as reference.

As may be seen from FIG. 8, R-G(H) is changed from a negative value through 0 to a positive value with the increasing depth 1C of the cut-out 3A.

On the other hand, B-G(H) is monotonously decreased with increasing depth 1C of the cut-out 3A.

However, in the present embodiment, B-G(H) is not zero if the depth 1C of the cut-out 3A is not larger than approximately 5 mm.

In the present embodiment, the R-G(H) is equal to B-G (H) if the depth 1C of the cut-out 3A is pp 3.8 mm.

At this time, the R-G(H) and B-G(H) values are both approximately 0.6 mm, which corresponds to an optimum value in the present embodiment.

Meanwhile, in the present embodiment, the point of intersection of R-G(H) and B-G(H) is not zero on the vertical axis.

However, the point of intersection can be zero since the value on the vertical axis of the point of intersection is varied by changing the shape of the cut-out 3A. The particular value to be in use should be determined with other designing parameters being taken into account.

With the present electron beam deflection device, as described above, convergence adjustment may be made by providing the core 3 of the horizontal deflection yoke 1 with a circular cut-out 3A without the necessity of adjusting the distribution of the deflection coil winding.

Also, in this electron beam deflection device, the core may be molded with a pre-set dimensional error for optimization.

In the above-described embodiment, the cut-out is provided on only one side edge of the core.

Alternatively, both side edges of the core may be formed with cut-outs, or only the edge on the electron beam incident side of the core may be provided with the core.

The cut-out may also be trapezoidal, free curve, a pre-set curve derived from a pre-set function, an interpolated curve interconnecting sample points, or a set of line segments interconnecting sample points.

What is claimed is:

1. An electron beam deflection device for a cathode ray tube comprising:

a horizontal deflection-yoke constituted by a first core and a first coil, and a vertical deflection yoke constituted by a second core and a second coil;

wherein said first core is of a flat annular shape, with upper and lower surfaces of a through-hole thereof operating as facing magnetic poles;

said horizontal deflection yoke is mounted on an electron gun side of the cathode ray tube;

said vertical deflection yoke is mounted on a phosphor surface side of the cathode ray tube; and wherein a cut-out is formed on one of forward and rear ends of said first core or on one of forward and rear ends of said second core.

2. The electron beam deflection device according to claim 1 wherein said second core is of a flat annular shape, with left and right surfaces of a through-hole thereof operating as facing magnetic poles.

3. The electron beam deflection device according to claim 1 wherein said second core is of a circular annular shape.

4. The electron beam deflection device according to claim 1 wherein said second core is of a squared annular shape.

5. The electron beam deflection device according to claim 1 wherein said cut-out is of an arcuate or elliptical shape.

6. The electron beam deflection device according to claim 1 wherein said cut-out is trapezoidally-shaped.

7. The electron beam deflection device according to claim 1 wherein said cut-out is of a free curve shape.

8. The electron beam deflection device according to claim 1 wherein said cut-out is of an interpolated curve interconnecting sample points.

* * * * *